US009381554B2

(12) United States Patent
Kümmerling et al.

(10) Patent No.: US 9,381,554 B2
(45) Date of Patent: Jul. 5, 2016

(54) METHOD FOR PRODUCING SEAMLESS HOT-ROLLED PIPES IN CONTINUOUS PIPE ROLLING MILLS

(75) Inventors: Rolf Kümmerling, Duisburg (DE); Christoph Prasser, Essen (DE); Gerd Homberg, Mettmann (DE); Frank Hagemann, Willich (DE); Gabriel Pereira, Oberhausen (DE); Winfried Braun, Düsseldorf (DE)

(73) Assignee: VALLOUREC DEUTSCHLAND GMBH, Düsseldorf (DE)

( * ) Notice: Subject to any disclaimer, the term of this patent is extended or adjusted under 35 U.S.C. 154(b) by 398 days.

(21) Appl. No.: 13/885,914

(22) PCT Filed: Sep. 19, 2011

(86) PCT No.: PCT/DE2011/001782

§ 371 (c)(1),
(2), (4) Date: Jul. 26, 2013

(87) PCT Pub. No.: WO2012/065585

PCT Pub. Date: May 24, 2012

(65) Prior Publication Data

US 2013/0333433 A1 Dec. 19, 2013

(30) Foreign Application Priority Data

Nov. 16, 2010 (DE) ..... 10 2010 052 084

(51) Int. Cl.

| | |
|---|---|
| ***B21B 19/04*** | (2006.01) |
| ***B21B 23/00*** | (2006.01) |
| ***B21B 17/04*** | (2006.01) |

(52) U.S. Cl.

CPC ..... *B21B 19/04* (2013.01); *B21B 23/00* (2013.01); *B21B 17/04* (2013.01)

(58) Field of Classification Search

CPC ..... B21B 17/04; B21B 19/04; B21B 23/00
See application file for complete search history.

(56) References Cited

U.S. PATENT DOCUMENTS 4,478,065 A * 10/1984 Gancia et al. ..... 72/239
6,024,808 A * 2/2000 Kondo et al. ..... 148/541

(Continued)

FOREIGN PATENT DOCUMENTS

| | | |
|---|---|---|
| EP | 1 102 033 | 5/2001 |
| EP | 1 463 591 | 6/2005 |
| EP | 1 611 969 | 1/2006 |
| EP | 1 764 167 | 9/2009 |
| WO | WO 2010/146546 | 12/2010 |

OTHER PUBLICATIONS

International Search Report issued by the European Patent Office in International Application PCT/DE2011/001782 on Mar. 15, 2012.

(Continued)

*Primary Examiner* — Teresa M Ekiert
(74) *Attorney, Agent, or Firm* — Henry M. Feiereisen LLC

(57) ABSTRACT

In a method for producing seamless pipes, a hot hollow block created previously in a piercing mill is stretched by means of a continuous rolling mill on a mandrel bar to form a parent pipe and the parent pipe is fed directly to a stretch reducing mill or sizing mill as a finishing mill, while forgoing an extracting mill and a reheating furnace, and is rolled there to the required final pipe diameter. The hollow block is pre-dimensioned in its length in such a manner that only a single length is produced as the required parent pipe length during the stretching in the continuous rolling mill and the parent pipe is pulled off of the mandrel rod by the finishing rolling during the subsequent finishing rolling, wherein the rolling is performed using rolling mill components that are designed in the dimensions thereof for handling single lengths.

6 Claims, 1 Drawing Sheet

(56) References Cited

U.S. PATENT DOCUMENTS

| | | | | |
|---|---|---|---|---|
| 6,666,094 | B1 | 12/2003 | Sauerland | |
| 2007/0216126 | A1* | 9/2007 | Lopez et al. | 72/369 |
| 2010/0064753 | A1* | 3/2010 | Sasaki | 72/370.01 |

OTHER PUBLICATIONS

Stahlrohr Handbuch , Vulkan-Verlag, Essen, 12$^{th}$ edition 1995, pp. 107-111.

* cited by examiner

METHOD FOR PRODUCING SEAMLESS HOT-ROLLED PIPES IN CONTINUOUS PIPE ROLLING MILLS

CROSS-REFERENCES TO RELATED APPLICATIONS

This application is the U.S. National Stage of International Application No. PCT/DE2011/001782, filed Sep. 19, 2011, which designated the United States and has been published as International Publication No. WO 20121065585 A1 and which claims the priority of German Patent Application, Serial No. 10 2010 052 084.5, filed Nov. 16, 2010, pursuant to 35 U.S.C. 119(a)-(d).

BACKGROUND OF THE INVENTION

The invention is directed to a method for the economical production of seamless hot-rolled pipes in continuous pipe rolling mills according to the preamble of patent claim 1. The invention is further directed to a rolling mill according to patent claim 8.

Various methods used for the production of hot-rolled seamless pipe are described in Stahlrohr Handbuch (Vulkan-Verlag, Essen, 12th edition 1995, pages 107-111).

In recent years, it has become increasingly necessary to produce products in a consumer-oriented manner because the consumer countries desire participation through job creation and value added tax. This necessarily entails limitations on the sales market.

Typical products in such cases are, for example, pipes for the energy sector for oil and gas exploration and production.

The current range of dimensions is between approximately 60 mm and 273 mm in diameter and approximately 5 mm to 15 mm in wall thickness.

The required capacity for pipe rolling mills ranges approximately between 100,000 and 250,000 tons per year for these products.

After the round starter material has been heated, seamless hot-rolled pipe is usually manufactured in three process steps:

- the solid block is pierced to form the hollow block,
- the hollow block is stretched to form the mother pipe, and
- the mother pipe is finish-rolled to the hot finished pipe dimensions.

Owing to the fact that, barring exceptional cases, cross rolling piercing mills are used for the first finishing step and finish rolling is carried out exclusively by means of stretch reducing mills or sizing mills, the rolling mills as a whole are named after the stretch reducing mills that are used.

Rolling mills with a yearly capacity in the above-mentioned range are push bench rolling mills, Assel rolling mills and Diescher rolling mills. In the latter two, cross rolling mills are used for stretching.

Operation of these rolling mills requires a high level of know-how, since it is not easy to produce pipe without external or internal defects. Typical pipe defects are, e.g., small cracks, to some extent having a shallow depth. The risk of defects increases as wall thickness decreases. Therefore, the ratio of diameter to wall thickness is limited. In Assel mills, for example, this ratio is 20:1. In Diescher mills, internal cracks can hardly be avoided, so that the pipes must be reworked.

This qualitative disadvantage and the demanding requirements of the oil and gas industry prohibit the use of these rolling methods for the production of premium products without costly mechanical work on the inner and outer surfaces of the pipe.

For these exacting products, longitudinal rolling has found general acceptance for quality reasons for stretching the hollow block by the continuous pipe rolling process; in longitudinal rolling, the hollow block undergoes a reduction in cross section of up to 75% in up to nine roll stands which are arranged closely one behind the other, which results in a four-fold stretching in length. The reduction in cross section to the mother pipe dimensions required for finish rolling is carried out continuously. A method of this kind is known, for example, from EP 1 764 167 B1.

The possible range of dimensions in the continuous pipe rolling method is approximately 25 mm to 498 mm in outer diameter; this diameter range cannot be covered by an individual rolling mill. Disregarding the furnace for heating the starter material, a current-day continuous pipe rolling mill in its entirety typically has the following composition:

- cross rolling mill for piercing with a maximum length of the hollow block between 11 m and 12.5 m,
- stretching unit (e.g., 2-roll or 3-roll continuous pipe rolling mill with retained bars) having 5 or 6 stands,
- bar circulation of the stretching unit with 5 to 8 bars, bar length of around 20 m, approximately one half thereof as working part for rolling, the other half for bridging the distance between the actual rolling mill and the bar retaining system,
- extracting mill comprising 3 stands, each having 3 rolls, for removing the mother pipe from the rolling bar,
- reheating furnace,
- sizing mill or stretch reducing mill,
- cooling bed.

The rolling bar retaining system has the following purpose:

- threading the rolling bar into the hollow block,
- pushing the hollow block with rolling bar into the first stand of the rolling mill,
- retaining the rolling bar during rolling in such a way that it moves forward at a constant speed below the entry speed of the hollow block into the first stand,
- returning the rolling bar to the entry side of the rolling mill after rolling is terminated.

The rolling bar is then ejected laterally into the bar circulation for cooling and lubrication and a "new" rolling bar is delivered to the rolling bar retaining system on the return side of the bar circulation.

In the known plant, the extracting mill is at a distance of approximately 10 m to 12 m from the end of the final stand of the two-roll or three-roll continuous pipe rolling mill. The extraction of the mother pipe from the rolling bar begins as soon as the tip of the mother pipe enters the first stand of the extracting mill. At this time, part of the mother pipe is still located in the continuous pipe rolling mill. As soon as the mother pipe has exited the extracting mill, the rolling bar is withdrawn. At this time, the tip of the rolling bar is located just in front of the first stand of the extracting mill.

Often, the mother pipes must be reheated prior to finish rolling. There are two reasons for this. First, the temperature varies for different wall thicknesses of the mother pipe. Thin-walled pipes cool much faster than thick-walled pipes. Given the same diameter at the exit of the stretch reducing mill or sizing mill, this influences the cold finished pipe diameter depending on the differing amount of shrinkage. A second reason is that a cooling of the mother pipes below about 600° C. allows a normalizing of the material when subsequently heated again in the reheating furnace to temperatures above Ac3.

Apart from the capability of these known rolling mills to roll premium-quality pipe, plant concepts of this kind have a very high production capacity which ranges from 300,000 to 900,000 tons/year depending on the range of dimensions and on production time.

This method is made particularly economical through the possibility of continuous rolling of multiple lengths, i.e., in accordance with the required pipe length, a hollow block length is used which, when stretched, yields a multiple length which is then severed to the required individual pipe length after finish rolling with a minimum of waste scrap.

However, it is disadvantageous that with an annual capacity of only 100,000 to 250,000 tons for premium product these rolling mills which are designed for high annual capacities and set up at high investment costs cannot be operated efficiently.

EP 1 764 167 B1 provides suggestions for increasing efficiency particularly by doing away with the extraction mill. Owing to a controlled movement of the mandrel bar counter to the rolling direction in the continuous rolling mill, this mandrel bar is substantially removed from the mother pipe at the conclusion of the rolling process so that a separate extraction mill is superfluous.

However, there are practical drawbacks to the described technical steps suggested for complete removal of the rolling bar from the mother pipe (stripping). For example, stripping by means of a stripper—at least in the case of thin wall thicknesses—always entails flaring of the end of the mother pipe which must absolutely be sawed off before the subsequent sizing or stretch reduction. In technological respects, stripping by means of a roller table is also critical because the time during which the process takes place cannot be controlled.

Further, the described steps are still not sufficient for substantial improvement of the efficiency of the process because the investment costs for the rolling mill are still very high in spite of the elimination of the extraction mill. Therefore, additional cost-cutting measures must be taken to increase efficiency.

A method for producing wire, rods, or seamless pipes on a rolling mill is known from EP 1 764 167 B1. To achieve an optimal mode of operation with reduced plant costs, a three-roll continuous rolling mill is used in the main stage for rotary piercing in pipe production and for solid rolling in the production of rods, wire or the like.

Finally, the production of seamless steel pipes in three deformation steps, including piercing in a cross rolling mill, stretching in an Assel mill, continuous rolling mill or other mill, and finish rolling in a stretch reducing mill, is known from EP 1 102 033 A1.

SUMMARY OF THE INVENTION

It is the object of the present invention to provide a method and a rolling mill by means of which pipes can be produced efficiently even with a comparatively low annual demand using a continuous pipe rolling mill while avoiding the above-mentioned drawbacks of known continuous pipe rolling mills. In particular, the rolling mill is to be constructed in a simpler and less expensive manner.

This object is met according to a method for producing seamless pipes, including: providing a hollow block generated beforehand in a piercing mill and having a defined length, wherein the defined length is selected as a function of a single length of a mother pipe to be produced; stretching the hollow block on a mandrel bar into the mother pipe defined by the single length by using a continuous rolling mill; feeding the mother pipe directly into a finishing mill constructed as stretch reducing mill or sizing mill without using an extracting mill or a reheating furnace; and rolling the mother pipe in the stretch reducing mill or sizing mill to a final pipe diameter, wherein rolling components of the stretch reducing mill and sizing mill are dimensioned for handling the single length; and extracting the mother pipe from the mandrel bar by the rolling. Advantageous further developments are indicated in the dependent claims. A rolling mill for implementing the method includes: a cross rolling mill; a continuous rolling mill; as finishing mill constructed as a stretch reducing mill or sizing mill; roller tables; a cooling bed; and a sawing area with pipe end cutting, wherein the finishing mill directly adjoins the continuous rolling mill in a rolling direction without an additional extracting mill or furnace between the finishing mill and the continuous rolling mill, wherein individual rolling mill components dimensioned to handle single pipe lengths of the mother pipe, and wherein a distance between the continuous rolling mill and the finishing mill in the rolling direction is minimal with respect to a handling of single pipe lengths.

With respect to the method, the above-stated object is met according to the invention in that a hot hollow block which is generated beforehand is stretched by means of a continuous rolling mill on a mandrel bar to form a mother pipe and, dispensing with an extracting mill and reheating furnace, the mother pipe is fed directly to a stretch reducing mill or sizing mill as finishing mill and is rolled therein to the required finished pipe diameter, wherein the length of the hollow block is pre-dimensioned in such a way that only a single length is produced as required mother pipe length during stretching in the continuous rolling mill, the mother pipe is removed from the mandrel bar by the finish rolling, and the rolling is carried out with rolling mill components whose dimensions are designed for handling single lengths.

The great advantage of the invention consists in that the proposed method now makes it possible to manufacture premium-quality seamless pipes having a low annual demand in a very economical manner also in continuous pipe rolling mills whose capacities are adapted to the demand.

An important factor affecting plant costs is pipe length. For reasons of efficiency, known rolling mills for the production of seamless pipe are designed so that mother pipes having a length between 28 m and 30 m, i.e., multiple lengths, can be rolled.

This means that all units from the furnace to the cooling bed, including all transporting systems such as roller tables, etc., must be designed to handle these lengths.

By limiting to single lengths, i.e., mother pipe lengths of approximately 14 m to 15 m, the lengths of the rolling mill components and, therefore, costs can be appreciably reduced.

A rolling mill which can produce pipes having outer diameters between 108 mm and 273 mm, for example, yields the following differences:

| | Standard continuous pipe rolling mill | Rolling mill according to the invention |
|---|---|---|
| starter material length | 5.0 m | 3.6 m |
| hollow block length | 12.0 m | 9.0 m |
| mother pipe length | 29.0 m | 14.5 m |
| cooling bed length | 42.0 m | 16.0 m |

Accordingly, the required length of the cooling bed is reduced to less than 40% of the standard length.

Further, limiting to single lengths allows the reduction in wall thickness to be decreased in the second process step of the stretching step. In known continuous rolling mills, wall reductions of about 10 mm to 15 mm are customary depending on the diameter range and number of stands.

If the wall thickness reduction is limited to values below 9 mm, only three stands are required according to the invention instead of the five to six stands used in standard operating modes. Therefore, in an advantageous further development of the invention, the wall thickness reduction is limited to less than 9 mm.

Ideally, in the continuous pipe method, the annular cross-sectional area of the entering hollow block is reduced to a smaller annular cross-sectional area with respect to diameter and wall thickness. The wall thickness of the mother pipe is identical to the wall thickness of this smaller cross-sectional area. It is typical of the method that the difference between the two cross-sectional areas is not dependent on the magnitude of the wall thickness of the mother pipe.

The way in which this reduction in cross section takes place and is divided among the stands is decided by the uniformity of wall thickness during rolling and by the stability, i.e., the reproducibility and susceptibility to rolling defects.

According to the invention, the following distributions have proven advantageous for the geometric layout of deformation in the three roll stands for the reduction in cross section mentioned above:

Stand 1 (entry stand): 50-60%

Stand 2 (intermediate stand): 35-40%

Stand 3 (exit stand): 5-7.5%

In the standard construction of a continuous rolling mill, the first three stands generally perform extensive deformation work and the following two to three stands perform less, which is also why two groups of component sizes are used.

Therefore, by limiting to small wall thickness reductions in accordance with the invention, it is possible to make do with one stand instead of three in the large component group. Correspondingly, the small component group having less deformation work then has only two stands.

After rolling, premium products for oil and gas exploration and production are always subjected to heat treatment in the form of hardening and tempering. This eliminates the usually required normalizing and, therefore, the investment in a reheating furnace.

Eliminating the reheating furnace allows the extraction and finish rolling to be performed in one step according to the invention. Therefore, the distance which would otherwise be necessary between the extracting mill of a 2-roll or 3-roll continuous pipe rolling mill and the finishing mill in the form of a stretch reducing mill or sizing mill is entirely dispensed with because the position of the extracting mill is now occupied by the sizing mill or stretch reducing mill itself.

The distance between the continuous pipe rolling mill and the sizing mill or stretch reducing mill participating in the extraction of the pipe from the bar can be shortened below the currently conventional 10 to 12 m. Limiting to a single length of the mother pipe by itself allows this distance to be shortened by approximately half. A further shortening is possible when the speed of the rolling bar is reduced. A lower limit for the distance is given by the type of stand changing selected (lateral changing or changing in the rolling line) in the stretching unit.

When the stands are pulled out in the rolling line, a corresponding place must be available which is, however, shorter than in the standard construction type due to the decreased number of stands. In case of lateral stand changing, the maximum traveling distance of the bar determines the required minimum intermediate space.

Due to the fact that the rolling bar is also subjected to reduced thermal loading because of the decreased wall thickness reduction and the reduced number of stands, the expensive portion of the rolling bar exposed to wear can be correspondingly shorter, which helps further to greatly reduce cost.

Further, the temperature differences are appreciably reduced because of the shorter contact time. Thus, the second reason for installing a reheating furnace in a (complete) continuous pipe rolling mill is also obviated.

As the above comparison shows, the cooling bed is also significantly shorter. Economies can also be made with respect to the parting saws. When a stretch reducing mill is used for finish rolling, two parting saws are sufficient instead of the usual four saws.

Accordingly, the parting saws can even be dispensed with entirely when working with a sizing mill because the required end cuts can be carried out in the nondestructive testing area which generally has one or more cutting installations for cutting out defects and taking samples.

Further, the roller tables for transporting pipes can be designed so as to be substantially shorter. If a finishing department is attached directly to the stretch reducing mill or sizing mill, one saw is sufficient to carry out a top cut so that the installation for nondestructive testing of pipe is not destroyed by untidy pipe ends.

The usual drawback in yield of single lengths in known complete continuous pipe rolling mills can be improved in an advantageous manner, for example, by rolling "pointed" pipe wall ends which compensates for the wall flaring during the subsequent stretch reduction which would normally lead to a thickening of the ends of the pipe in excess of tolerances.

Further, pipes produced particularly in 3-roll continuous pipe rolling mills have a very good concentricity which compensates for the disadvantage of a possibly lower yield.

Therefore, according to the invention, the rolling mill is designed as a 3-stand rolling mill with three rolls per stand in an advantageous further development.

The particular method using single lengths of mother pipe and the consequent elimination of expensive rolling mill units which would otherwise be necessary substantially compensates, or overcompensates, for the disadvantage of a low output of the rolling mill in relation to annual capacity.

Suitable selection of starter material formats and the quantity of different passes for finishing different finished pipe diameters are extremely important for the reliable and efficient operation of a rolling mill. The goal is to keep the quantity of formats and passes which it is necessary to stock as small as possible.

By "format" is meant herein the outer diameter of the starter material block. By "pass" is meant the outer diameter of the mother pipe after the 3-roll continuous pipe rolling mill. Correspondingly different formats and passes are required for finishing different finished pipe diameters.

Therefore, in order to make do with the fewest possible different formats and passes to be stocked, the minimum quantity N of required passes is determined in a first step in an advantageous further development of the invention by the following formula:

$$N = \text{rounded up to whole number: } (\log(D\text{-pipe-max}/D\text{-pipe-min})/\log(C1)), \quad \text{(Formula 1)}$$

where

D-pipe-max is the maximum finished pipe diameter in mm;

D-pipe-min is the minimum finished pipe diameter in mm;

and the constant C1, which describes the useful circumferential reduction of the associated rolling unit, has the following values:

2=C1=4 for stretch reducing mills, 1.2=C1=1.45 for sizing mills.

If only one pass is required, the range for the block diameter DB is given, according to the invention, by the following formula (in mm):

$$DB=(D\text{-pipe-max}\times C2+C3)/(1+C4), \quad \text{(Formula 2)}$$

where
1.04=C2=1.12
22=C3=28
−0.03=C4=0.15.

In this case, the constants describe the limiting values of the capacities of the units sizing mill (C5), stretch reducing mill (C2), continuous pipe rolling mill (C3), and cross rolling mill (C4) which are relevant for the changes in diameter.

If more than one pass is required, the additional block diameter ranges are given by the following equation:

$$DB=(D\text{-pipe-min}\times C5 \text{ exp. pass number } n \text{ (where } n=1, 2, 3 \ldots)+C3)/(1+C4), \quad \text{(Formula 3)}$$

where
1.4=C5=1.45
22=C3=28
−0.03=C4=0.15.

The constant C5 describes the maximum deformation capacity of the sizing mill and, in so doing, replaces constant C2.

The following two examples show the method for calculation and decision.

EXAMPLE 1

Pipes having the following diameters are to be produced:
D-pipe-max=139.7 mm
D-pipe-min=60.3 mm
Therefore, the pipe dimensions are in the typical range for a stretch reducing mill.

According to Formula 1, with the corresponding limits of C1, this gives the following quantity N of passes:

$$N=\text{rounded up}(\log(139.7/60.3)/\log(2))=\text{rounded up}(1.2121)=$$

$$N=\text{rounded up}(\log(139.7/60.3)/\log(4))=\text{rounded up}(0.6061)=1$$

This means that one pass is sufficient to cover the range of dimensions.

The following range is given by Formula 2 for the block diameter to be used:

$$DB \text{ min}=(139.7\times1.04+22)/1.15=145.5 \text{ mm}$$

$$DB \text{ max}=(139.7\times1.12+28)/0.97=190.2 \text{ mm}$$

Therefore, a suitable format can be selected from the existing block formats, for example, 165 mm or 180 mm.

EXAMPLE 2

Pipes having the following diameters are to be produced:
D-pipe-max=273.1 mm
D-pipe-min=108.0 mm
Therefore, the pipe dimensions are in the transitional range between sizing mill and stretch reducing mill.

For a stretch reducing mill, with the corresponding limits of C1 according to Formula 1, the following quantity of passes is given:

$$N=\text{rounded up}(\log(273.1/108.0)/\log(2))=\text{rounded up}(1.3383)=2$$

$$N=\text{rounded up}(\log(273.1/108.0)/\log(4))=\text{rounded up}(0.6692)=1$$

This means that one pass is sufficient.

If a sizing mill is chosen, Formula 1 gives the following:

$$N=\text{rounded up}(\log(273.1/108.0)/\log(1.2))=\text{rounded up}(5.0883)=6$$

$$N=\text{rounded up}(\log(273.1/108.0)/\log(1.45))=\text{rounded up}(2.4968)=3$$

This means that three passes are required in a sizing mill.

The following range is given by Formula 2 for the block diameter of the largest pass for a stretch reducing mill:

$$DB \text{ min}=(273.1\times1.04+22)/1.15=266.1 \text{ mm}$$

$$DB \text{ max}=(273.1\times1.12+28)/0.97=344.2 \text{ mm}$$

A suitable format can be selected in this way from the existing block formats, for example, 270 mm or 310 mm.

However, more than one block format is required in case of the sizing mill. Therefore, the following calculation must be used to reach a final decision:

For pass 1:

$$DB \text{ min}=(108.0\times1.41+22)/1.15=150.6 \text{ mm}$$

$$DB \text{ max}=(108.0\times1.451+28)/0.97=190.3 \text{ mm}$$

and for pass 2:

$$DB \text{ min}=(108.0\times1.42+22)/1.15=203.2 \text{ mm}$$

$$DB \text{ max}=(108.0\times1.452+28)/0.97=263.0 \text{ mm}$$

These three block diameter ranges cover the diameters between 108 mm and 273 mm without gaps. If gaps are allowed, the minimum finished pipe diameter of the respective pass number n must be taken into account instead of the minimum diameter of the total range:

$$DB=(D\text{-pipe-min(pass number } n)\times C5+C3)/(1+C4),$$

where
1.4=C5=1.45
22=C3=28
−0.03=C4=0.15.

If pass 2 begins, for example, with a pipe diameter of 168.3 mm (in theory, pass 1 ends with 108×C5=108×1.45=156.6 mm), the following block diameter would result for this pass:

$$DB \text{ min}=(168.3\times1.41+22)/1.15=224.0 \text{ mm}$$

$$DB \text{ max}=(168.3\times1.451+28)/0.97=280.4 \text{ mm.}$$

This results in an overlapping range with pass 3 (266.1 mm to 280.4 mm) and an additional block format can be dispensed with.

BRIEF DESCRIPTION OF THE DRAWING

Further features, advantages and details of the invention are indicated in the following description of an embodiment example shown in the drawings.

DETAILED DESCRIPTION OF PREFERRED EMBODIMENTS

Figure 1:
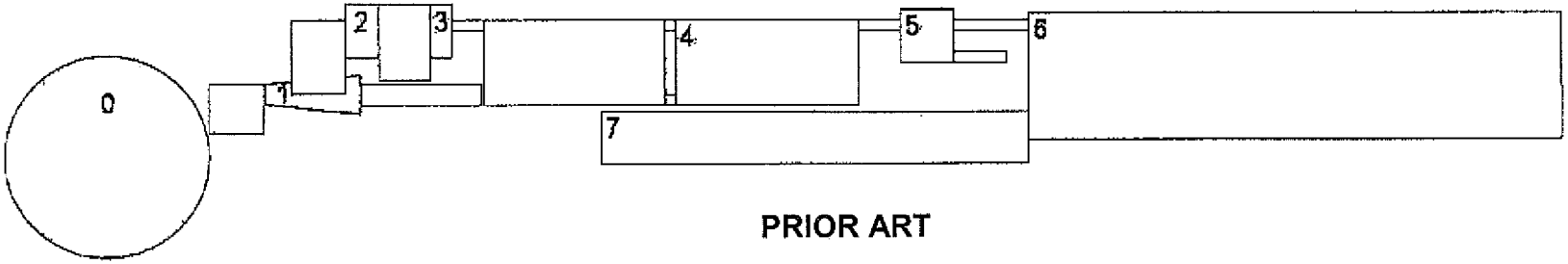
PRIOR ART FIG. 1
FIG. 1 shows the known plant layout of a continuous pipe rolling mill.

FIG. 1 shows the known plant layout of a continuous pipe rolling mill, as total rolling mill, for rolling multiple lengths.

In addition to the rotary hearth furnace (0), the total rolling mill has a cross rolling mill (1) for piercing a solid block, not shown, to form a hollow block, a stretching unit as 3-roll continuous pipe rolling mill (2) for stretching the hollow block to form a mother pipe, an extracting mill (3) for stripping the mother pipe from the mandrel bar, a reheating furnace (4) for reheating the mother pipe to rolling temperature, a stretch reducing mill (5) for rolling the mother pipe to final dimensions, a cooling bed (6), and a sawing area with pipe end cutting arrangement (7).

The extracting mill (3) comprises three stands, each having three rolls, for extracting the mother pipe from the rolling bar.

Figure 2:
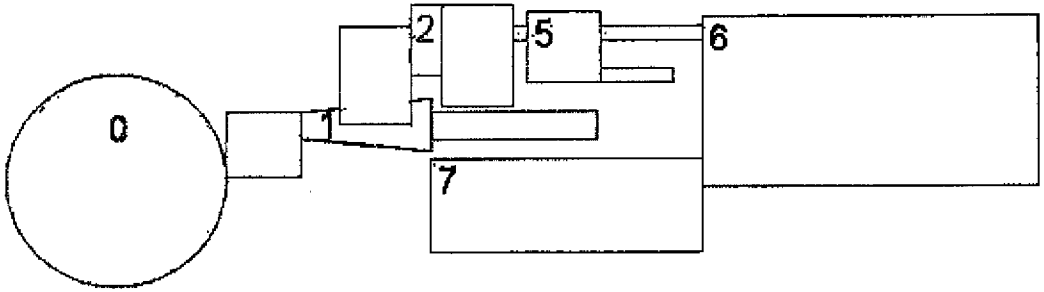
FIG. 2 shows the plant layout of the rolling mill according to the invention.

In comparison, FIG. 2 shows the plant layout of the rolling mill according to the invention. It can be seen by direct comparison that the plant concept according to the invention is distinguished by a substantially reduced overall length.

By systematic implementation of the concept of rolling single lengths of mother pipe, the total length of the continuous rolling mill is substantially reduced by dispensing with the extracting mill (3) and reheating furnace (4) and by adapting the length of the cooling bed (6) and sawing area with pipe end cutting arrangement (7).

The investment costs for the rolling mill according to the invention are correspondingly reduced compared to the known continuous rolling mill.

In addition, the rolling mill is provided with an in-line testing unit, not shown in the drawing, which further reduces investment costs and operating costs. The in-line testing unit comprises an installation for nondestructive testing preceded by a straightening machine, leakage flux testing for longitudinal and transverse defects, and an ultrasound wall thickness examination, and along with a repair circuit for pipes to be reworked, directly adjoins the cooling bed (6).

Accordingly, separate quality control outside the finishing line is dispensed with. Further, this testing allows fast reporting of quality problems in the rolling mill, minimum cropping of pipes in which only necessary sawing is carried out, and also allows pipes which have already been tested to be used for heat treatment and other finishing lines. In this way, the through-put times for pipes and, therefore, finishing efficiency are appreciably increased.

This has already proven to be extremely successful in trials in plants for finished pipes having outer diameters of =177.8 mm. However, the metric capacity in plants for the finishing of smaller pipe diameters, particularly in known continuous pipe rolling mills, is so high that the nondestructive testing facility cannot handle the amount of pipe presented for testing. This is only allowed again by limiting to single lengths of mother pipe.

The invention claimed is:

1. A method for producing seamless pipes, comprising:

providing a hollow block generated beforehand in a piercing mill and having a defined length, said defined length being selected so that a mother pipe produced from the hollow block has a single length;

stretching the hollow block on a mandrel bar into the mother pipe defined by the single length by using a continuous rolling mill;

feeding the mother pipe directly into a finishing mill constructed as stretch reducing mill or sizing mill, without using an extracting mill or a reheating furnace;

rolling the mother pipe in the stretch reducing mill or sizing mill to a final pipe diameter, wherein rolling components of the stretch reducing mill and sizing mill are dimensioned for handling the single length;

extracting the mother pipe from the mandrel bar by the rolling; and calculating a minimum quantity N of pass diameters required for producing a plurality of different said final pipe diameter according to the following formula:

$$N = \text{rounded up to whole number: } (\log(D\text{-pipe-max}/D\text{-pipe-min})/\log(C1)),$$

wherein D-pipe-max is a maximum finished pipe diameter in mm, wherein, D-pipe-min is a minimum finished pipe diameter in mm, wherein $2 \le C1 \le 4$ when the finishing mill is constructed as stretch reducing mills, and wherein $1.2 \le C1 \le 1.45$ when the finishing mill is constructed as sizing mill.

2. The method of claim 1, wherein the stretching in the continuous rolling mill is carried out with maximally three stands and three rolls per stand.

3. The method of claim 2, wherein the stretching in the continuous rolling mill is carried out with three stands and three rolls per stand wherein 50-60% of a reduction of a cross section of the hollow block to a cross section of the mother pipe during the stretching step is performed on a first one of the three stands, 35-40% of the reduction is performed on a second one of the three stands, and 5-7.5% of the reduction is performed on a third one of the three stands.

4. The method of claim 1, wherein a total reduction of a wall thickness of the hollow block in the continuous rolling mill is ≤9 mm.

5. The method of claim 1, further comprising calculating a range for a diameter for the hollow block when the rolling step is carried out with one pass, according to the following formula:

block diameter DB in mm:

$$DB = (D\text{-pipe-max} \times C2 + C3)/(1 + C4),$$

wherein $1.04 \le C2 \le 1.12$, wherein $22 \le C3 \le 28$, and wherein $-0.03 \le C4 \le 0.15$.

6. The method of claim 1, wherein when more than one pass is required, additional ranges for the diameter of the hollow block are calculated according the following equation:

block diameter DB in mm:

$$DB = (D\text{-pipe-min} \times C5 \text{ exp. pass number } n + C3)/(1 + C4),$$

where $1.4 \le C5 \le 1.45$ $22 \le C3 \le 28$ $0.03 \le C4 \le 0.15$.

* * * * *